US009228583B2

(12) United States Patent
Cui et al.

(10) Patent No.: US 9,228,583 B2
(45) Date of Patent: Jan. 5, 2016

(54) LIQUID PUMP DEVICE

(71) Applicants: Ming Cui, Guangdong (CN); Lian Zhang, Guangdong (CN)

(72) Inventors: Ming Cui, Guangdong (CN); Lian Zhang, Guangdong (CN)

( * ) Notice: Subject to any disclaimer, the term of this patent is extended or adjusted under 35 U.S.C. 154(b) by 0 days.

(21) Appl. No.: 14/110,564

(22) PCT Filed: Oct. 30, 2012

(86) PCT No.: PCT/CN2012/083770
§ 371 (c)(1),
(2) Date: Oct. 8, 2013

(87) PCT Pub. No.: WO2014/059698
PCT Pub. Date: Apr. 24, 2014

(65) Prior Publication Data

US 2014/0105735 A1 Apr. 17, 2014

(30) Foreign Application Priority Data

Oct. 16, 2012 (CN) ..... 2012 1 0391851

(51) Int. Cl.

| | |
|---|---|
| ***B65D 37/00*** | (2006.01) |
| ***F04B 53/16*** | (2006.01) |
| ***B05B 15/00*** | (2006.01) |
| *F04B 43/00* | (2006.01) |
| *B05B 11/00* | (2006.01) |

(52) U.S. Cl.
CPC ..... *F04B 53/16* (2013.01); *B05B 11/3032* (2013.01); *B05B 11/3069* (2013.01); *B05B 11/3097* (2013.01); *B05B 15/005* (2013.01); *B05B 11/0043* (2013.01); *F04B 43/0063* (2013.01)

(58) Field of Classification Search
CPC .. A45D 34/04; B05B 15/005; B05B 11/0043; B05B 11/3032; B05B 11/3033; B05B 11/3097; B05B 11/3069; F04B 1/0404; F04B 53/16; F04B 43/0063; G01F 11/08
USPC ..... 222/105, 207, 209, 255, 320, 321.3, 222/321.7, 375, 380, 383.1, 490, 498, 531, 222/532, 631–633, 95; 415/182.1
See application file for complete search history.

(56) References Cited

U.S. PATENT DOCUMENTS

| | | | | | |
|---|---|---|---|---|---|
| 1,783,419 | A * | 12/1930 | Fitch | 222/309 |
| 3,726,442 | A * | 4/1973 | Davidson et al. | 222/207 |
| 3,820,689 | A * | 6/1974 | Cocita | 222/207 |
| 4,322,020 | A * | 3/1982 | Stone | 222/95 |
| 5,871,126 | A * | 2/1999 | Bennett et al. | 222/207 |
| 2011/0139825 | A1 * | 6/2011 | Houghton | 222/207 |

* cited by examiner

*Primary Examiner* — Frederick C Nicolas
*Assistant Examiner* — Bob Zadeh
(74) *Attorney, Agent, or Firm* — Tim Tingkang Xia; Locke Lord LLP

(57) ABSTRACT

The invention relates to a liquid pump device, having a pump shell body, a soft rubber pressing device, a discharge channel, a sealed discharge cap, and a guiding tube. The pump shell body has an upper shell and a lower shell connected to form a first cavity communicated with the discharge channel. The lower shell has an arc surface with an upward opening. A flange is arranged at the lower end of the arc surface of the lower shell, a through hole being arranged at the middle of the flange. The soft rubber pressing device forms a second cavity with the lower shell. The sealed discharge cap has at least one cut forming a discharge port, and is sleeved to an end portion of the discharge channel. The guiding tube is arranged in the through hole of the flange, and is communicated with the second cavity via the feeding channel.

7 Claims, 4 Drawing Sheets

LIQUID PUMP DEVICE

FIELD OF THE INVENTION

The present invention relates to a liquid pump device.

BACKGROUND OF THE INVENTION

Liquid pump devices are typically installed at the mouths of containers, and are used for pumping liquid products inside the container out of the containers. In a typical liquid pump device, the liquid is pumped out of the container through up and down movement of the piston rod, such that the liquid is discharged from the discharge port. FIG. 1 illustrates a liquid pump device in the prior art. When a user presses the press head of the press pump, a lower one-way valve 180 is turned off, and an upper one-way valve 140 is turned on. The upper one-way valve is formed of the outer circumferential surface of a piston rod 152 and a piston member 141 installed on the circumferential surface. The outer circumferential surface of the piston rod 152 serves as a valve base, and the piston member 141 serves as a valve member. The liquid product in a liquid storage tank 130 in a cylinder 160 is conveyed out of the container through the turned-on upper one-way valve 140 and a conveying channel 151 of the piston 150, and a discharge channel 111 of the press head 110. The piston 150 is formed of the piston rod 152 and the piston member 141 on the piston rod 152, wherein the piston rod 152 and the piston member 141 simultaneously serve as members of the one-way valve 140 and the piston 150. To be specific, the one-way valve 140 is provided as a part of the piston 150. The conveying channel 151 and the discharge channel 111 form a distribution channel for pumping and distributing the liquid product from the liquid storage tank 130 to the outside of the container. When the user cancels the pressing onto the press head 110, the press head 110 restores to its original position under the action of an elastic restoration device 120; and during restoration of the press head 110, the lower one-way valve 180 is turned on, the upper one-way valve 140 is turned off, the liquid product in the container is suctioned by the lower one-way valve 180 to the liquid storage tank 130 for subsequent pumping and distribution. Generally, the distribution channel is arranged between the upper one-way valve 140 and an outlet portion 112 of the press head 110.

Such liquid pump device has a defect in terms of design. Specifically, upon completion of the press, pumping and distribution operations of the liquid pump device each time, liquid product still remains at the outlet portion of the press head, the liquid remain will trickle onto the surface where the container is placed or on the container, especially when the container is being moved or being replaced. As for liquid products (for example, oil-like or water-like products) with low viscosity and good flowability, even if the container is not moved and suffers from no shock, after a period of time, the liquid remain at the outlet portion approximate the press head will also trickle under the gravity, thereby causing undesired pollution.

Accordingly, it is desirable to provide a new-type liquid pump device

SUMMARY OF THE INVENTION

To overcome the above defects, the present invention provides an improved liquid pump device, wherein the liquid pump device is installed in a container, for conveying liquid in the container to the outside of the container. The liquid pump device according to the present invention, employing sealing design, prevents the unused liquid in the container from contamination due to contact with ambient environment, improves actual usage rate of the liquid in the container, and features simple structure, low cost, and no pollution.

The technical solution of the present invention is a liquid pump device, comprising a pump shell body, a soft rubber pressing device, a discharge channel, a sealed discharge port end cap, and a guiding tube.

The pump shell body comprises an upper shell and a lower shell, wherein the lower shell is provided with an arc surface with an upward opening, the upper shell and the lower shell are connected to form a cavity and the discharge channel communicated with the cavity, and a flange is arranged at the lower end of the arc surface of the lower shell, a through hole being arranged at the middle of the flange.

The soft rubber pressing device comprises an arc-shaped pressing sheet and an integrally formed and arranged elastic support sheet, the soft rubber pressing device is snap-fit connected onto the upper shell and covers the cavity, and the soft rubber pressing device forms a cavity with the lower shell.

The sealed discharge port end cap is provided with at least one cut, the cut forming an invisible discharge port, and the sealed discharge port end cap is sleeved onto an end portion of the discharge channel.

The guiding tub is arranged in the through hole of the flange, and is communicated with the cavity via the feeding channel.

In an embodiment, the sealed discharge port end cap is fabricated by soft rubber.

The sealed discharge port end cap is integrally welded to a side wall of the discharge channel.

A side wall of the lower shell is provided with at least one one-way intake channel.

A lower part of the lower shell is provided with a connection port, and at least one of the one-way intake channel(s) is communicated with the connection port.

In another embodiment, the liquid pump device further comprises a soft sealed bladder, wherein the soft sealed bladder is connected to an upper end portion of the guiding tube, and the guiding tube is arranged in the soft sealed bladder.

A wall of the guiding tube is provided with at least one through hole.

The present invention achieves the following beneficial effects:

The liquid pump device according to the present invention, employing a sealed discharge port end cap and an invisible discharge port, can effectively prevent the remaining liquid product in the distribution channel from trickling from the mouth of the press head. The liquid pump device according to the present invention, employing sealing design, prevents the unused liquid in the container from contamination due to contact with ambient environment. The present invention further proposes a soft sealed bladder to further protect the liquid product, and meanwhile prevents waste of the liquid product. In addition, the liquid pump device employing elastic automatic restoration of the soft rubber pressing device requires no restoration spring, and has a simple structure. The liquid pump device may be fabricated using degradable plastic materials, and therefore the liquid pump device is easy for dismantlement, convenient for dismantlement, and simple in disposal after being scrapped, and causes damages and pollution to environment.

DETAILED DESCRIPTION OF THE EMBODIMENTS

The present invention is described in detail with reference to accompanying drawings and specific embodiments.

Figure 1:
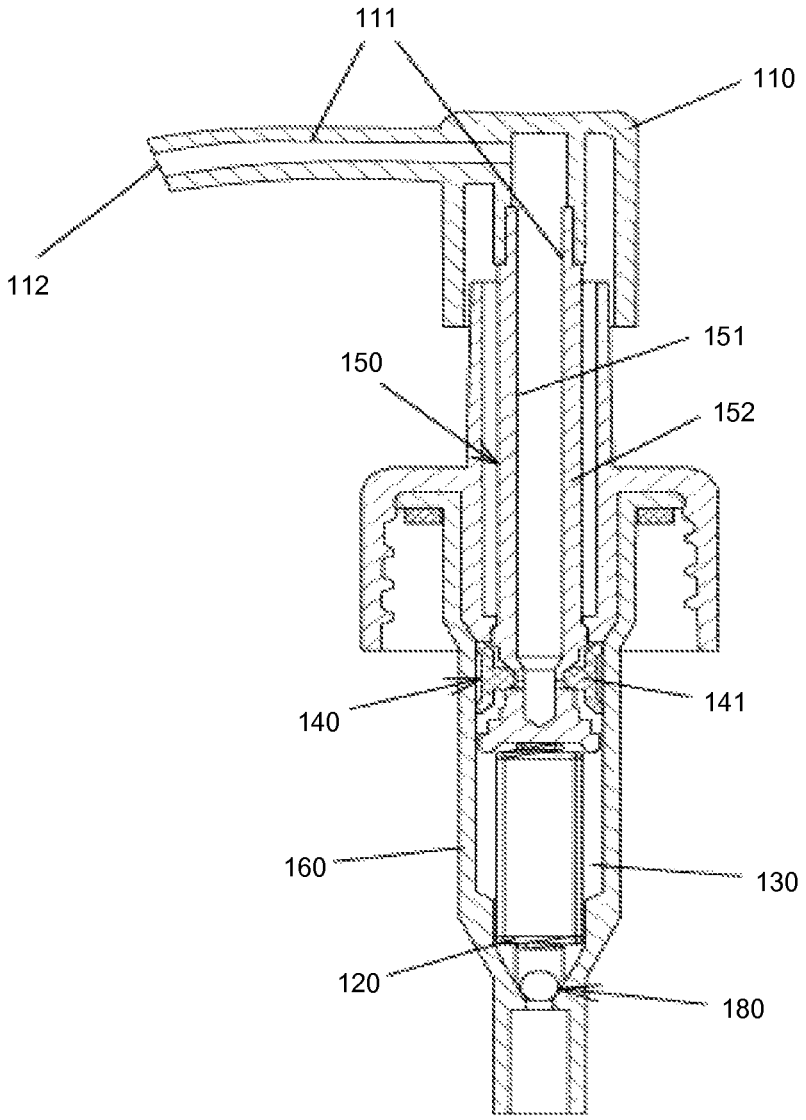
FIG. 1 (Prior Art)
FIG. 1 is a schematic structural view of a liquid pump device in the prior art.
Figure 2:
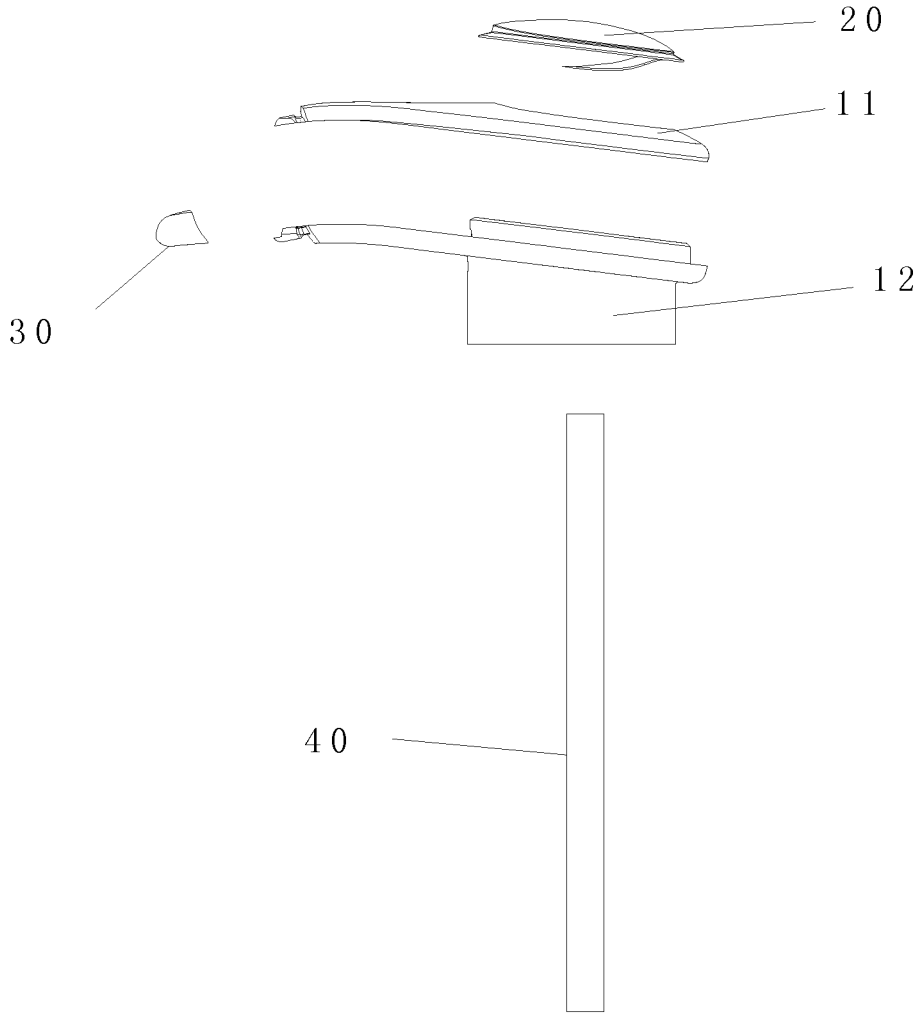
FIG. 2 is a schematic exploded view according to a first embodiment of the present invention.
Figure 3:
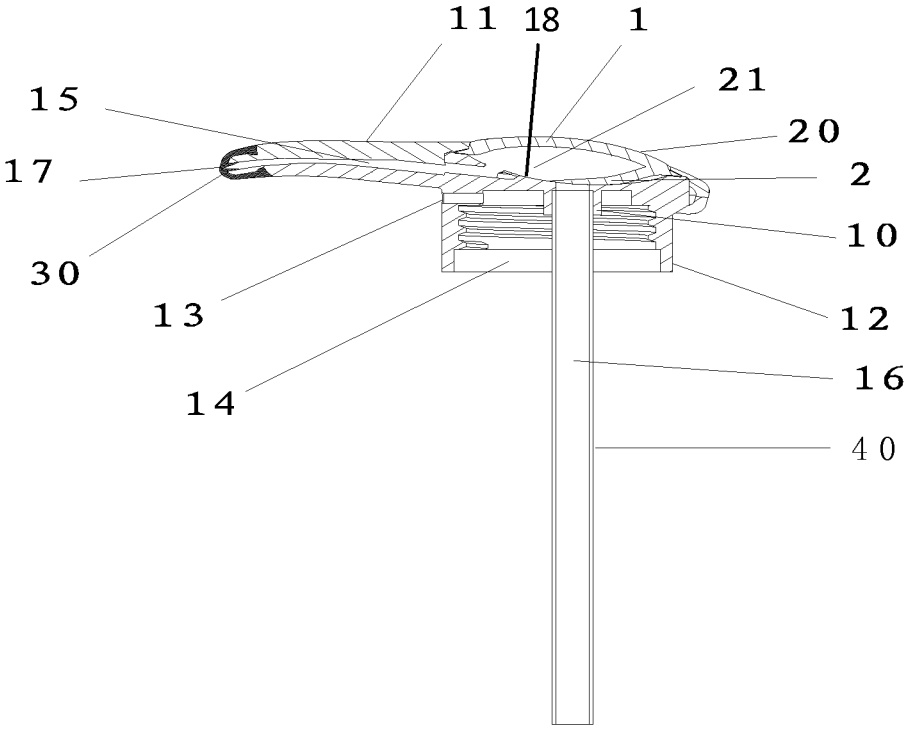
FIG. 3 is a schematic structural view according to the first embodiment of the present invention.

FIG. 2 and FIG. 3 illustrate a structure of the liquid pump device according to a first embodiment of the present invention. In this embodiment, the liquid pump device comprises a pump shell body, a soft rubber pressing device 20, a sealed discharge port end cap 30, and a guiding tube 40.

The pump shell body comprises an upper shell 11 and a lower shell 12, wherein the lower shell 12 is provided with an arc surface 18 with an upward opening. The upper shell 11 and the lower shell 12 are connected to form a cavity and the discharge channel 15 communicated with the cavity. A flange 10 is arranged at the lower end of the arc surface 18 of the lower shell 12, a through hole 14 being arranged at the middle of the flange 10. The guiding tube 40 is arranged in the through hole 14, and is communicated with the cavity via the feeding channel 16.

The soft rubber pressing device 20 comprises an arc-shaped pressing sheet 1 and an integrally formed and arranged elastic support sheet 2. The soft rubber pressing device 20 is snap-fit connected onto the upper shell 11, and covers the cavity formed by the upper and lower shells. The soft rubber pressing device 20 forms a cavity 21 with the lower shell 12.

The sealed discharge port end cap 30 employs a soft bowl-shaped structure, and is provided with at least one cut, the cut forming an invisible discharge port 17. The discharge channel 15 is narrowed at an end portion thereof, and the sealed discharge port end cap 30 is sleeved onto the end portion of the discharge channel 15.

A lower part of the lower shell 12 is provided with a connection port 14, a side wall of the lower shell 12 is provided with at least one one-way intake channel 13, and at least one of the one-way intake channel(s) 13 is communicated with the connection port 14.

Figure 4:
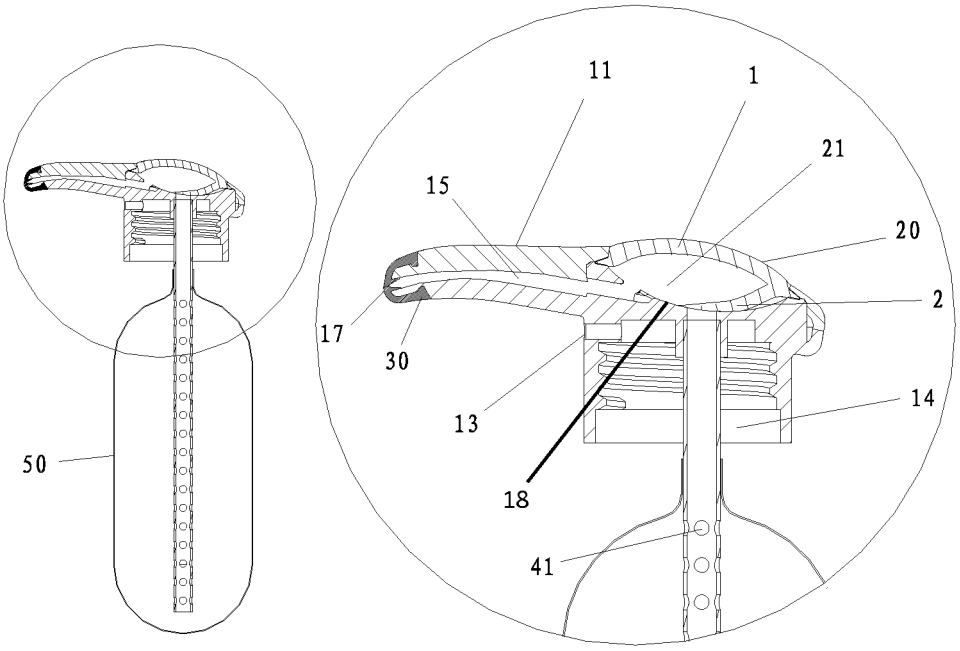
FIG. 4 is a schematic structural view according to a second embodiment of the present invention.
Figure 5:
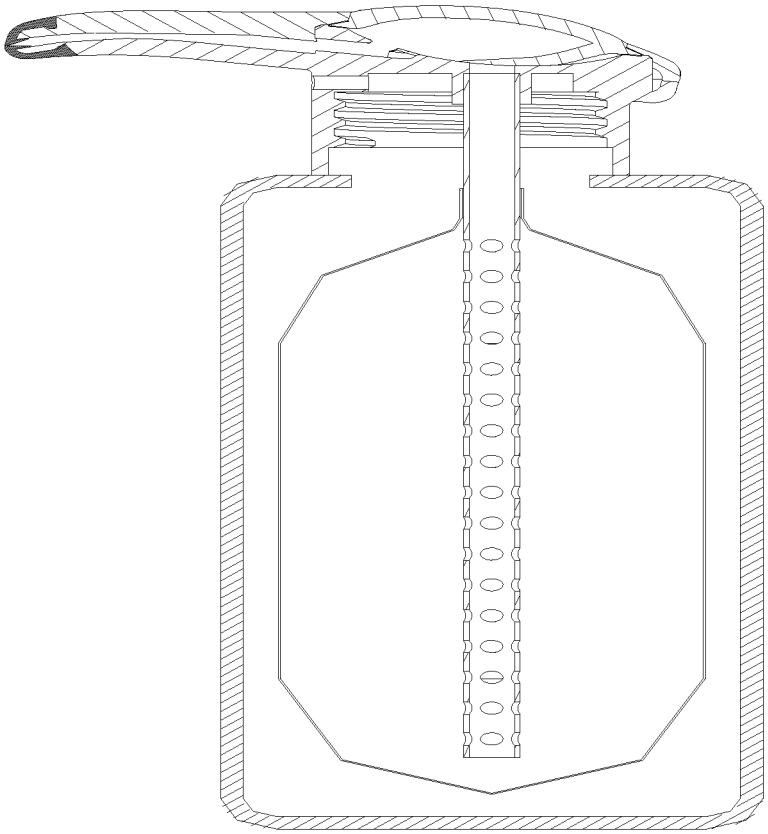
FIG. 5 is a schematic structural view of a liquid pump device installed in a container according to second embodiment of the present invention.

FIG. 4 is a schematic structural view according to a second embodiment of the present invention. Different from the first embodiment, in this embodiment, liquid is contained in a soft sealed bladder 50. The connection port 14 is connected to a bottle-shaped container, and the soft sealed bladder 50 is arranged in the bottle-shaped container. The soft sealed bladder 50 is seal-connected to the guiding tube 40, and the guiding tube 40 is arranged in the soft sealed bladder 50. A wall of the guiding tube 40 is provided with a plurality of through holes 41 arranged at different positions thereon.

During initial use of the liquid pump device, when the soft rubber pressing device 20 is pressed, the elastic support sheet 2 blocks the feeding channel 16, and the air in the discharge channel 15 and the cavity 21 is discharged under pressure at the invisible discharge port on the sealed discharge port end cap 30; when the soft rubber pressing device 20 is released from pressure, the elastic support sheet 2 is released, the feeding channel 16 is communicated with the cavity 21, and under a suction force produced by press and restore actions on the soft rubber pressing device 20, the liquid is conveyed through the guiding tube 40 and the feeding channel 15 into the cavity 21 of the pump shell body.

Subsequently, when the soft rubber pressing device 20 is pressed for a second time, the elastic support sheet 2 blocks the feeding channel 16, and under such pressure, the liquid in the cavity 21 is discharged through the discharge channel 15 and the invisible discharge port on the sealed discharge port end cap 30. When the pressure is canceled, the cut on the sealed discharge port end cap 30 is closed, and the liquid not discharged from the cavity 21 due to pressure is prevented from contacting with ambient environment, and remains in the discharge channel 15 and the cavity 21, facilitating subsequent use. When the soft rubber pressing device is released from pressure, the elastic support sheet 2 is released, the feeding channel 16 is communicated with the cavity 21, and the liquid in the soft sealed bladder 50 is suctioned through the guiding tube 40 into the cavity 21 to make a supplement to the discharged liquid, facilitating subsequent use. Meanwhile, the one-way intake channel 13 communicated with the connection port 14 supplements air to the bottle-shaped container to maintain a pressure to the soft sealed bladder 50. The suction force caused by pressing the soft rubber pressing device 20 makes the soft sealed bladder 50 deform, thereby increasing an acting force of suctioning the liquid into the cavity 21. In addition, since the guiding tube 40 is provided with a plurality of through holes 41 arranged on different positions on the wall thereof, such that even if there is a little liquid, the liquid can still be suctioned into the cavity 21. This improves the actual usage rate of the liquid.

When the liquid pump device according to the present invention is installed in a container, due to sealing design, the liquid is conveyed and distributed to the outside of the container under the suction force produced by press and restore actions on the soft rubber pressing device. Since the sealed discharge port end cap is arranged on the end portion of the discharge channel, the invisible discharge port formed by the cutter thereon effectively prevents the liquid in the container from contamination caused by contact with ambient environment.

According to the second embodiment of the present invention, the liquid pump device further comprises a soft sealed bladder, wherein the soft sealed bladder is used to receive liquid and is arranged in the container for preventing the unused liquid from contacting with ambient environment. In addition, the liquid is not directly contained in the container, but is protected by using the soft sealed bladder in the container. Furthermore, the wall of the guiding tube is provided with a plurality of through holes arranged at different positions thereon, which achieves maximum usage rate of the liquid in the container. Such structures are especially applicable to high level cosmetics. The liquid pump device according to the present invention has advantages of simple structure, low cost, and convenience for dismantlement, easiness for disposal after being scrapped, no damages and pollution to environment.

It should be noted that, persons of ordinary skill may make improvements or modifications according to the disclosure of the present invention, and those improvements and modifications shall fall within the scope defined by the appended claims.

What is claimed is:

1. A liquid pump device, comprising a pump shell body, a soft rubber pressing device (20), a discharge channel (15), a sealed discharge port end cap (30), and a guiding tube (40); wherein the pump shell body comprises an upper shell (11) and a lower shell (12), the lower shell (12) is provided with an arc surface (18) with an upward opening, the upper shell (11) and the lower shell (12) are connected to form a first cavity and the discharge channel (15) communicated with the first cavity, and a flange (10) is arranged at a lower end of the arc surface (18) of the lower shell (12), a through hole (14) being arranged at the middle of the flange;

the soft rubber pressing device (20) comprises an arc-shaped pressing sheet (1) and an integrally formed and arranged elastic support sheet (2), the soft rubber pressing device (20) is snap-fit connected onto the upper shell (11) and covers the first cavity, and the soft rubber pressing device (20) forms a second cavity (21) with the lower shell (12);

when the soft rubber pressing device (20) is pressed, the elastic support sheet (2) blocks a feeding channel (16); when the soft rubber pressing device (20) is released from pressure, the elastic support sheet (2) is released, and the feeding channel (16) is communicated with the second cavity (21);

the sealed discharge port end cap (30) is provided with at least one cut, the cut forming a discharge port (17), the discharge channel (15) is narrowed at an end portion of the discharge channel (15), and the sealed discharge port end cap is sleeved onto the end portion of the discharge channel (15); and the guiding tube (40) is arranged in the through hole of the flange (10), and is communicated with the second cavity (21) via the feeding channel (16).

2. The liquid pump device according to claim 1, wherein the sealed discharge port end cap (30) employs a soft bowl-shaped structure.

3. The liquid pump device according to claim 1, wherein the sealed discharge port end cap (30) is integrally welded to a side wall of the discharge channel (15).

4. The liquid pump device according to claim 1, wherein a side wall of the lower shell (12) is provided with at least one one-way air intake channel (13).

5. The liquid pump device according to claim 4, wherein a lower part of the lower shell (12) is provided with a connection port (14), and the at least one one-way air intake channel (13) is communicated with the connection port (14).

6. The liquid pump device according to claim 1, further comprising a soft sealed bladder (50), wherein the soft sealed bladder (50) is connected to an upper end portion of the guiding tube (40), and the guiding tube (40) is arranged in the soft sealed bladder (50).

7. The liquid pump device according to claim 6, wherein a wall of the guiding tube (40) is provided with at least one through hole (41).

* * * * *